United States Patent [19]

Mori et al.

[11] Patent Number: 4,840,739

[45] Date of Patent: Jun. 20, 1989

[54] ADHESIVE GREASE COMPOSITION COMPRISING A RANDOM COPOLYMER OF ETHYLENE AND AN ALPHA-OLEFIN

[75] Inventors: Shigeru Mori, Annaka; Takayuki Takahashi, Gunma, both of Japan

[73] Assignee: Shin-Etsu Chemical Co., Ltd., Japan

[21] Appl. No.: 169,038

[22] Filed: Mar. 16, 1988

[30] Foreign Application Priority Data

Mar. 17, 1987 [JP] Japan ..... 62-60070

[51] Int. Cl.[4] ..... C10M 107/22

[52] U.S. Cl. ..... 252/17; 252/18; 252/20; 252/21; 252/27; 252/42.1; 252/49.6

[58] Field of Search ..... 252/18, 21, 20, 40.7, 252/49.6, 27, 56 S, 56 D, 5 A, 42.1, 17

[56] References Cited

U.S. PATENT DOCUMENTS

| | | | |
|---|---|---|---|
| 2,062,346 | 12/1936 | Zimmer et al. | 252/40.7 |
| 2,275,123 | 3/1942 | Zimmer et al. | 252/40.7 |
| 2,514,331 | 7/1950 | Morway | 252/40.7 |
| 2,680,095 | 6/1954 | Hotten et al. | 252/40.7 |
| 3,200,073 | 8/1965 | Criddle | 252/56 D |
| 3,269,949 | 8/1966 | Borg | 252/40.7 |
| 4,294,713 | 10/1981 | Knollmueller et al. | 252/40.7 |
| 4,582,616 | 4/1986 | Kita et al. | 252/40.7 |

FOREIGN PATENT DOCUMENTS

| | | | |
|---|---|---|---|
| 0569318 | 1/1959 | Canada . | |
| 0589833 | 12/1959 | Canada | 252/20 |
| 60045240 | 1/1978 | Japan . | |
| 56-0016195 | 4/1981 | Japan . | |
| 530000776 | 10/1985 | Japan . | |

*Primary Examiner*—William R. Dixon, Jr.
*Assistant Examiner*—Margaret B. Medley
*Attorney, Agent, or Firm*—Lowe, Price, LeBlanc, Becker & Shur

[57] ABSTRACT

An adhesive grease composition comprises a random copolymer of ethylene and an alpha-olefin having the following formula $$\left(CH_2-CH_2\right)_x\left(CH_2-\underset{\displaystyle R}{\underset{|}{CH}}\right)_y$$

wherein R represents a lower alkyl group, x and y are, respectively, an integer provided that x/y=0.5 to 2.0 and x+y=50 to 150, and a thickening agent in defined amounts.

11 Claims, 1 Drawing Sheet

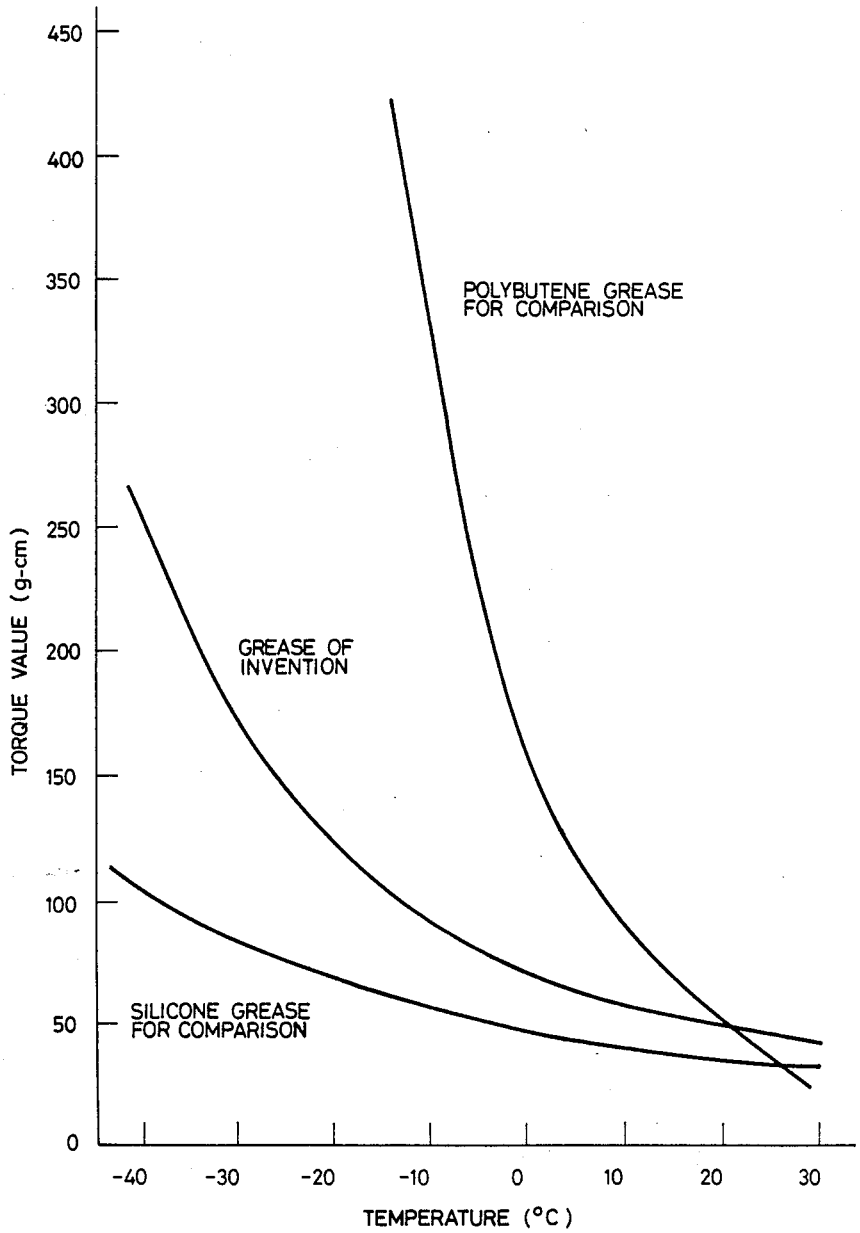
450
400
350
300
250
200
150
100
50
0
TORQUE VALUE (g-cm)
POLYBUTENE GREASE
FOR COMPARISON
GREASE OF
INVENTION
SILICONE GREASE
FOR COMPARISON
-40
-30
-20
-10
0
10
20
30
TEMPERATURE (°C)

ADHESIVE GREASE COMPOSITION COMPRISING A RANDOM COPOLYMER OF ETHYLENE AND AN ALPHA-OLEFIN

BACKGROUND OF THE INVENTION

1. Field of the Invention

This invention relates to lubricants and more particularly, to an adhesive grease composition which has stable lubricity over a wide temperature range.

2. Description of the Prior Art

As is well known in the art, adhesive greases have wide utility in various fields of automobiles, aircrafts, heating furnace conveyors, blowers or fans, household appliances, office machines, precision machines, instruments and the like. These adhesive greases are required to stabilize keep the lubricity under severe conditions of low to high temperatures.

Typical known adhesive greases used for these purposes include, for example, polybutene adhesive greases having good lubricity. The polybutene adhesive greases may be those in which polybutene is added to ordinary greases so as to impart adhesiveness thereto, and those in which polybutene is provided as a base oil to which a thickening agent or material is added thereby forming a greasy material. Although these polybutene adhesive greases have good lubricity, a disadvantage is involved in that the temperature-torque characteristic (hereinafter referred to simply as temperature characteristic) is poor.

On the other hand, silicone adhesive greases are known and described, for example, in Japanese Patent Publication Nos. 53-776 and 60-45240. These silicone adhesive greases have a good temperature characteristic, but the lubricity is very poor.

Other known adhesive greases are those comprised of polybutene and silicones as described, for example, in Japanese Patent Publication No. 56-16195. However, this type of adhesive grease has poorer lubricity than polybutene adhesive greases.

SUMMARY OF THE INVENTION

It is an object of the invention to provide an adhesive grease composition which overcomes the disadvantages of the prior art greases whereby while the composition has good lubricity similar to the lubricity of polybutene greases, a better temperature characteristic than the characteristic of polybutene greases is imparted.

It is another object of the invention to provide an adhesive grease composition which is comprised of a random copolymer of ethylene and an alpha-olefin as a base oil.

These objects can be achieved, according to the invention, by an adhesive grease composition which comprises: 100 parts by weight of a random copolymer of ethylene and an alpha-olefin having the following general formula $$\left(CH_2-CH_2\right)_x\left(CH_2-\overset{\overset{R}{|}}{CH}\right)_y$$

in which R represents an alkyl group having from 1 to 3 carbon atoms, and x and y are independently a positive integer provided that $x/y=0.5$ to 2.0 and $x+y=50$ to 150; and from5 to 100 parts by weight of a thickening agent.

DESCRIPTION OF THE DRAWING

The sole FIGURE is a temperature-torque characteristic for a grease composition of the invention and known greases for comparison.

DETAILED DESCRIPTION AND EMBODIMENTS OF THE INVENTION

The first ingredient used in the grease composition of the invention is a random copolymer or co-oligomer of ethylene and an alpha-olefin having the following formula $$\left(CH_2-CH_2\right)_x\left(CH_2-\overset{\overset{R}{|}}{CH}\right)_y$$

in which R is an alkyl group having from 1 to 3 carbon atoms, and x and y are, respectively, a positive integer provided that $x/y=0.5$ to 2.0 and $x+y=50$ to 150. Preferably, R represents a methyl group, and x and y are such values that $x/y=0.5$ to 1.5 and $x+y=70$ to 130. The copolymers used as a base oil are commercially available from Mitsui Petroleum Chemical Ind. Co., Ltd. under the designations of Lucant HC-20, HC-50, HC-100, HC-150, HC-600, and HC-2000. Of these, Lucant HC-600 and HC-2000 are preferred in view of the temperature characteristic. Lucant HC-600 is a product of the above formula in which R is a methyl group, and x=about 40 and y=about 40. Similarly, Lucant HC-2000 is a product of the above formula in which R is a methyl group, and x=about 50 and y=about 50.

The copolymer used as the first ingredient of the invention is better than mineral oils in the following respects. The copolymer is a colorless transparent liquid which has a good temperature characteristic and a good thermal oxidation resistance. Moreover, the copolymer has a low pour point, a high flash point of from 250° to 300° C. and a high ignition point of from 395° to 415° C., so that it is chemically stable. In addition, the copolymer has substantially no metal-corroding action.

The second ingredient essentially used in the composition of the invention is a thickening agent. The thickening agents may be any agents ordinarily used as such in grease compositions. Examples of the thickening agent include metallic soaps containing metals such as aluminum, lead, manganese, lithium, plutonium, calcium, barium, strontium, copper, mercury, bismuth, chromium, iron, nickel and the like, inorganic materials such as silica, alumina, iron oxide, lead oxide, clay, graphite, carbon and the like, and organic materials such as aryl ureas, phthalocyanine, Indanthrene, polytetrafluoroethylene and the like. Of these, lithium stearate and lithium hydroxystearate are preferred as the metallic soap, and silica is preferred as the inorganic material. When silica is used, it may be treated on the surfaces thereof with an alkoxysilane, chlorosilane, an organopolysiloxane containing hydroxyl groups at ends thereof, organic amine compounds or organic boron compounds.

The second ingredient is used in an amount of from 5 to 100 parts by weight per 100 parts by weight of the first ingredient. The thickening agent dispersed in the liquid copolymer is considered to form a network structure, so that the base oil or grease is prevented from running off to outside. If the amount is less than 5 parts by weight, the network structure is not satisfactorily formed, resulting in a grease composition which has too high a consistency and relatively poor adhesiveness. On the other hand, when the amount exceeds 100 parts by weight, the consistency becomes so small that the resultant grease cannot be used as a grease because of the excessive hardness or consistency.

The grease composition of the invention may further comprise, aside from the essential ingredients, additive oils. The additive oils include, for example, silicone oils, alpha-olefin oligomers, diester oils and the like. Examples of the silicone oils include dimethylsilicone oils, methylphenylsilicone oils, alpha-olefin-modified silicone oils, fluorosilicone oils and the like. These silicone oils are commercially available from ShinEtsu Chem. Co., Ltd. under the designations of KF 96, KF 50 and KF 54 for the silicone oils, KF 412 and KF 7235B for the alpha-olefinmodified silicone oils, and FL-100 for the fluorosilicone oil. In view of the miscibility with the first and second ingredients, alpha-olefin-modified silicone oils are preferred as the silicone oil. The alpha-olefin oligomers may be commercially available from Lion Co., Ltd. under the designation of PAOL, and the diester oils include, for example, dioctyl sebacate (DOS), dioctyl azelate (DOZ), dioctyl adipate (DOA) and the like.

These additive oils are used in amounts of up to 100 parts by weight based on 100 parts by weight of the first ingredient. As a matter of course, the additive oils may be used singly or in combination.

The additive oils are added to the first and second ingredients in order to control the adhesion strength.

If necessary, other additives such as antioxidants may be further added to the grease composition.

The grease composition of the invention can be obtained by merely mixing the starting materials or subjecting them to mixing under heating conditions or under reduced pressure and heating conditions. Subsequently, the mixture is further kneaded such as in a three-roll mill or a colloid mill to make a greasy composition.

The present invention is more particularly described by way of examples.

Examples 1-10 and Comparative Examples 1, 2.

Lucant HC 600 or HC 2000 was provided as a base oil. The base oil was first pre-mixed with various types of thickening agents and/or additive oils in a planetary mixer and then kneaded with a three-roll mill to obtain grease compositions Nos. 1 to 10 (Examples 1-10) of the invention. The compositions of Examples 1-3, 7, 9 and 10 made use of surface-treated silica as the thickener. For these compositions, the kneading with the three-roll mill was repeated several times in order to permit the treated silica to be well miscible and mixed with the base oil.

The respective grease compositions were subjected to the following tests.

For comparison, a silicone grease comprised of a methylphenylsilicone oil, a resin containing methylsiloxy groups and $SiO_2$ and silica, and a polybutene grease comprising polybutene, an alpha-olefin oligomer and silica were, respectively, subjected to the tests.

Measurement of Consistency:

The consistency of each grease composition was measured according to the method prescribed in JIS K 2220.

Measurement of Torque:

Each grease was applied to a $4\phi \times 8$ mm aluminum shaft and zinc bearings therefor. A torque was measured while rotating the shaft at 10 r.p.m. An initial torque value was taken as an initial torque. One revolution of the shaft per second was taken as one cycle. After 50 cycles, 150 cycles and 300 cycles, the torque was measured upon which the revolution of the shaft was 10 r.p.m.

Rotation Life Test:

Each grease was applied to a $4\phi \times 8$ mm aluminum shaft and zinc bearings. The applied shaft was rotated and one revolution per second was taken as one cycle. The number of the cycles before seizing of the shaft were measured when the rotation was effected at a rate of 1000 cycles/hour.

Temperature Characteristic Test:

Each grease was applied to a $4\phi \times 8$ mm aluminum shaft and zinc bearings. While an ambient temperature was changed, a torque was measured. During the measurement, the number of revolutions were 10 r.p.m.

The results are shown in Tables 1 and 2 and also in the sole FIGURE.

TABLE 1

| Ex. | Base Oil | Additive Oil | amount (parts by weight) | Thickener | amount (parts by weight) |
|---|---|---|---|---|---|
| 1 | HC-600*1 | alpha-olefin oligomer (PAOL 60) | 10 | treated silica-1*2 | 20 |
| 2 | HC-600 | — | 0 | treated silica-2*3 | 14 |
| 3 | HC-2000 | dioctyl sebacate | 10 | treated silica-2 | 14 |
| 4 | HC-2000 | alpha-olefin-modified silicone oil (KF-7235B) | 10 | silica (Aerosil 200) | 10 |
| 5 | HC-2000 | alpha-olefin-modified silicone oil (KF-7235B) | 30 | lithium stearate | 21 |
| 6 | HC-2000 | alpha-olefin oligomer (PAOL 400) | 5 | lithium-OH—stearate | 15 |
| 7 | HC-2000 | dimethyl-silicone (KF 96 500cs) | 10 | treated silica-1 | 8 |
| 8 | HC-2000 | alpha-olefin oligomer (PAOL 400) | 100 | silica (R-972*4) | 5 |
| 9 | HC-2000 | — | 0 | treated silica-2 | 14 |
| 10 | HC-2000 | dioctyl adipate | 100 | treated silica-1 | 100 |

TABLE 1-continued

| Ex. | Consistency | Torque Value (g-cm) Initial | 50 Cycles | 150 Cycles | 300 Cycles | Rotation Life Cycles Before Seizing |
|---|---|---|---|---|---|---|
| 1 | 305 | 20 | 19 | 17 | 17 | over 50,000 |
| 2 | 272 | 19 | 17 | 17 | 17 | " |
| 3 | 267 | 30 | 26 | 23 | 20 | " |
| 4 | 261 | 34 | 27 | 26 | 24 | " |
| 5 | 300 | 19 | 17 | 15 | 14 | " |
| 6 | 285 | 39 | 30 | 27 | 25 | " |
| 7 | 289 | 41 | 30 | 22 | 22 | " |
| 8 | 425 | 9 | 8 | 8 | 8 | " |
| 9 | 315 | 50 | 42 | 35 | 31 | " |
| 10 | 210 | 13 | 11 | 10 | 9 | " |

TABLE 2

| Comp. Ex. | Grease | Consistency | Torque Value (g-cm) Initial | 50 Cycles | 150 Cycles | 300 Cycles | Rotation Life Number of Cycles Before Seizing |
|---|---|---|---|---|---|---|---|
| 1 | silicone adhesive base oil/treated silica-2 | 320 | 48 | 35 | 32 | 30 | 15,000 |
| 2 | polybutene base oil/ treated silica-2 | 242 | 61 | 50 | 45 | 43 | over 50,000 |

Note 1: Lucant HC-600 base oil is used in an amount of 100 parts by weight.
Note 2: silica treated with $[(CH_3)_3Si]_2NH$
Note 3: silica treated with $(C_6H_5)_2Si(OH)_2$
Note 4: Aerosil and R-972 are both silica available from Degussa Co., Ltd.

The temperature characteristics of the grease compositions of Example 9 and the comparative examples are shown in the sole FIGURE.

From the results of the above tables and the FIGURE, it will be seen that the grease compositions of the invention have lubricity substantially equal or similar to the lubricity of the polybutene grease and are better in the temperature characteristic than the polybutene grease.

What is claimed is:

1. An adhesive grease composition which comprises: 100 parts by weight of a random copolymer of ethylene and an alpha-olefin having the following general formula $$\left(CH_2-CH_2\right)_x\left(CH_2-\overset{\overset{R}{|}}{C}H\right)_y$$

in which R represents an alkyl group having from 1 to 3 carbon atoms, and x and y are independently a positive integer provided that $x/y=0.5$ to 2.0 and $x+y=50$ to 150; and from 5 to 100 parts by weight of a thickening agent for the grease composition.

2. An adhesive grease composition according to claim 1, wherein said thickening agent is a metallic soap.

3. An adhesive grease composition according to claim 2, wherein said metallic soap is lithium stearate or lithium hydroxystearate.

4. An adhesive grease composition according to claim 1, wherein said thickening agent is silica.

5. An adhesive grease composition according to claim 4, wherein said silica is surface-treated silica.

6. An adhesive grease composition according to claim 1, wherein the alkyl group represented by R is a methyl group.

7. An adhesive grease composition according to claim 1, wherein $x/y=0.5$ to 1.5 and $x+y=70$ to 130.

8. An adhesive grease composition according to claim 1, further comprising up to 100 parts by weight of an additive oil selected from the group consisting of silicone oils, alpha-olefin oligomers, and diester oils.

9. An adhesive grease composition according to claim 8, wherein said additive oil is a silicone oil.

10. An adhesive grease composition according to claim 9, wherein said silicone oil is an alpha-olefin-modified silicone oil.

11. An adhesive grease composition according to claim 1, wherein said thickening agent is selected from the group consisting of metallic soaps containing a metal selected from the group consisting of aluminum, lead, manganese, lithium, plutonium, calcium, barium, strontium, copper, mercury, bismuth, chromium, iron and nickel; inorganic materials selected from the group consisting of silica, alumina, iron oxide, lead oxide, clay, graphite and carbon; and organic materials selected from the group consisting of aryl ureas, phthalocyanine, Indanthrene and polytetrafluoroethylene.

* * * * *